US005605111A

United States Patent [19]

Culpepper

[11] Patent Number: 5,605,111

[45] Date of Patent: Feb. 25, 1997

[54] SUBMERSIBLE AQUATIC SLED

[76] Inventor: Thomas G. Culpepper, P.O. Box 1976, Indiantown, Fla. 34956

[21] Appl. No.: 574,996

[22] Filed: Dec. 19, 1995

[51] Int. Cl.[6] ..... B63C 11/46

[52] U.S. Cl. ..... 114/315; 441/65

[58] Field of Search ..... 114/315, 242, 114/244, 245, 253, 254, 144 R; 441/65, 75, 79, 66, 67, 68, 69

[56] References Cited

U.S. PATENT DOCUMENTS

| | | | |
|---|---|---|---|
| D. 252,050 | 6/1979 | Stern | D21/228 |
| 3,593,356 | 7/1971 | Schmalfeldt | 9/310 E |
| 4,389,195 | 6/1983 | Sohael | 440/15 |
| 4,439,165 | 3/1984 | Rothstein | 441/74 |
| 4,708,675 | 11/1987 | Schoeffler et al. | 441/65 |
| 4,894,034 | 1/1990 | Brown, III | 441/65 |
| 4,929,208 | 5/1990 | Corica | 441/75 |
| 4,990,113 | 2/1991 | Morrison | 441/65 |
| 5,055,075 | 10/1991 | Waller, Jr. | 441/55 |
| 5,114,370 | 5/1992 | Moran | 441/65 |
| 5,178,090 | 1/1993 | Carter | 114/253 |
| 5,224,890 | 7/1993 | Moran | 441/65 |
| 5,318,467 | 6/1994 | McIntyre | 441/65 |
| 5,389,023 | 2/1995 | McIntyre | 441/65 |
| 5,462,001 | 10/1995 | Lemelson | 114/144 R |
| 5,482,485 | 1/1996 | Ball | 114/253 |

*Primary Examiner*—Stephen Avila
*Attorney, Agent, or Firm*—John C. Smith

[57] ABSTRACT

A submersible aquatic sled capable of towing a diver both on the water's surface and below the water's surface. The sled has a tow line attachment at the distal end to attach the sled to a tow line which is pulled by a boat. The sled has steering handles which allow the sled to be steered above and below the surface by changing the orientation of the plane of the sled. The sled submerges when the distal end of the sled is pointed downward and rises to the surface when the distal end of the sled is pointed upward. The distal edge of the sled is rounded to reduce turbulence and drag resistance. Optional hand shields, mounted to the surface of the sled, protect the hands of the diver.

10 Claims, 12 Drawing Sheets

SUBMERSIBLE AQUATIC SLED

BACKGROUND OF THE INVENTION

1. Technical Field

The present invention relates to aquatic devices. In particular, it relates to submersible sleds which can tow a diver on the surface or underwater.

2. Background Art

A number of devices have been developed for water sports which act as a vehicle to allow an individual to move about on water. For example water skis are well known in the art and allow an individual to be towed behind a boat. While water skis provide the individual a substantial amount of enjoyment, they are restricted solely to surface use.

Another commonly used device is the surfboard. In addition to conventional surfboards, it is known that surfboards can be steered by incorporating rudder assemblies for surface steering which are similar to those used on boats. Likewise, surfboards with wind sails are known which allow a surfer to be propelled away from the waves where surfboards are normally used. Unfortunately, surfboards, like water skis, are devices that are restricted to surface use only.

Yet another commonly used device is the body board. A body board is similar to a surfboard except that it is smaller and designed to be used in a prone position, whereas a surfboard can be used in a prone or standing position. As was the case with the previous devices, body boards, like water skis and surfboards, are devices that are restricted to surface use only.

Another drawback to the aforementioned devices is that they require significant levels of skill for a user to steer. In the case of water skis, skills equivalent to snow skiers are required to effectively control direction. As to surfboards and body boards, the direction taken by these devices is generally dictated by the direction of the waves on which they ride.

Further, since the foregoing devices are restricted to surface use, they deprive the user of the opportunity to explore the substantial natural beauty that exists below the water's surface.

The prior art has failed to provide a device which can be used both above and below the surface of the water. In addition, the prior art has failed to provide a device which can be rapidly towed above or below the surface of the water such that the user can explore large aquatic areas in a convenient manner. Likewise, the prior art has failed to provide a device which can accomplish the foregoing and at the same time provide the user with the convenience of being easily maneuverable.

SUMMARY OF THE INVENTION

The present invention solves the foregoing problems by providing a submersible aquatic sled capable of towing a diver both on the surface and below the surface. The sled has a tow line attachment at the distal end to attach the sled to a tow line which is pulled by a boat. The sled has steering handles which allow the sled to be steered above and below the surface as well as laterally by changing the orientation of the plane of the sled. The sled submerges when the distal end of the sled is pointed downward and rises to the surface when the distal end of the sled is pointed upward. Lateral movement is accomplished by rotating the plane of the sled such that one side is lower than the other and pointing the distal end of the sled in the desired direction. The distal edge of the sled is rounded in the preferred embodiment to reduce turbulence and water drag resistance. Optional hand shields, mounted to the surface of the sled, protect the hands of the diver.

DESCRIPTION OF THE PREFERRED EMBODIMENT

Figure 1:
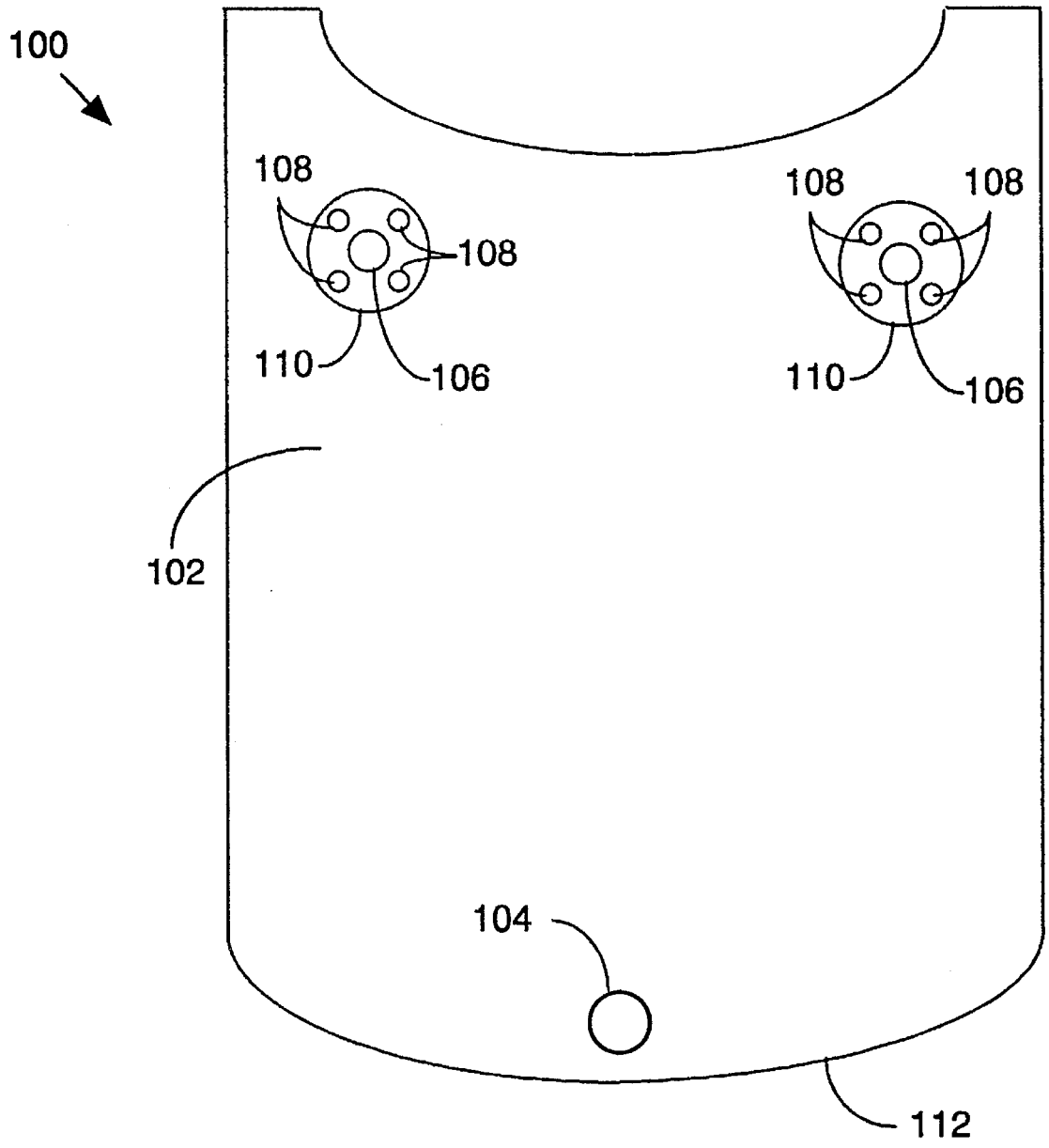
FIG. 1 is a top plan view of the submersible aquatic sled of the preferred embodiment.

Referring to FIG. 1, FIG. 1 is a top plan view of the submersible aquatic sled 100 (hereinafter, sled 100) used in the preferred embodiment. Sled 100 has a generally planar surface 102. Aperture 104 is located at the distal end of sled 100, near distal edge 112, and provides the means to attach a tow rope 404 to sled 100. Those skilled in the art will recognize that any number of suitable methods and devices can be used to attach the tow rope 404 to sled 100. For example, hook assembles, latches, etc could be built into sled 100 for this purpose. Likewise, it is also possible to incorporate quick disconnect devices and pressure release devices to disengage the tow rope 404 from either sled 100 or boat 402.

In the preferred embodiment, handles 106, mounting brackets 110 and bolts 108 form a handle assemblies 106, 108, 110 which is used to control the maneuvering of sled 100. However, since handle assembly 106, 108, 110 are designed such that they can be comfortably grasped by a user, those skilled in the art will recognize that any number of configurations can be used to implement the handle assemblies 106, 108, 110. For example, a single handle could also be used which would allow both hands to grasp it.

Figure 4:
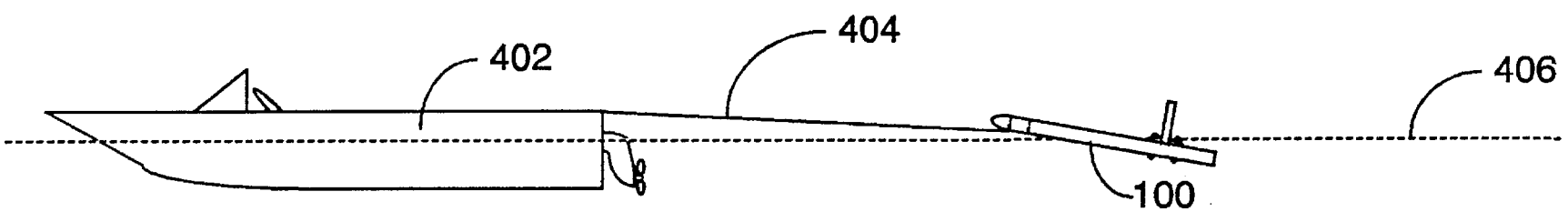
FIG. 4 illustrates the submersible aquatic sled in the surface towing position.

In the preferred embodiment it is envisioned that sled 100 will be pulled by a conventional boat 402 via a tow rope 404 (both shown in FIG. 4). Likewise, the materials used to construct sled 100 can be any material that is suitable for use in water. For example, planar surface 102 can polyurethane treated wood, plastic, rubber, etc. In addition, handle assemblies 106, 108, 110 can even be molded with planar surface 102 as an integral unit.

The length and width of sled 100 is not critical. Preferably, sled 100 should be wide enough that handle assemblies 106, 108, 110 can be conveniently grasped. Likewise, the length of sled 100 is not critical and only needs to provide sufficient surface area such that it can control the movement of itself and the diver who is controlling it. In the preferred embodiment, widths of approximately 1.5 to 2 feet and lengths of approximately 2 feet have been found adequate for most individuals. Of course, sled 100 sizes can be varied to suit divers of unusual size.

Figure 2:
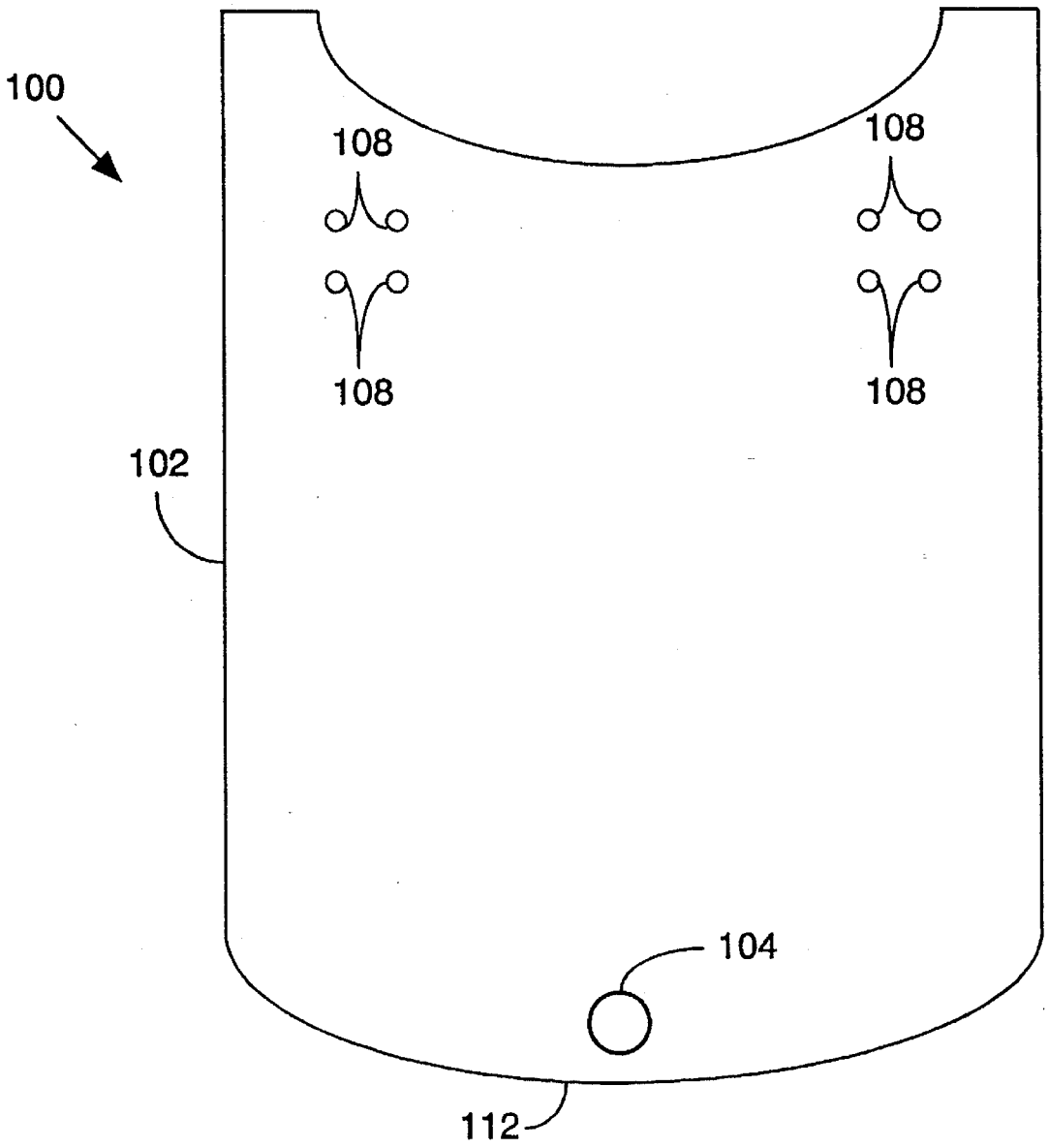
FIG. 2 is a bottom plan view of the submersible aquatic sled of the preferred embodiment.

FIG. 2 is a bottom plan view of sled 100. Showing bolts 108 secured to the bottom of planar surface 102.

Figure 3:
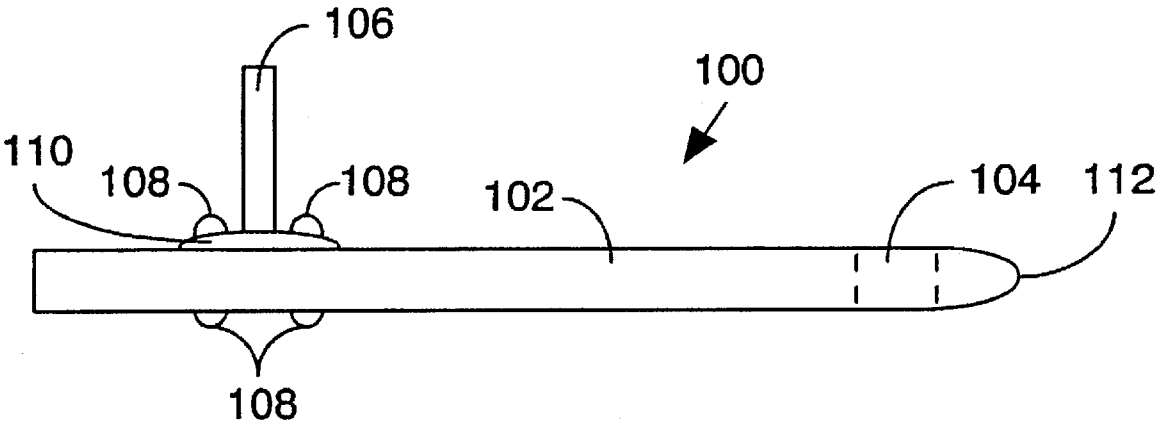
FIG. 3 is a side view of the submersible aquatic sled of the preferred embodiment.

In FIG. 3, a side view of sled 100 is shown. The location of aperture 104 is shown in dashed lines. In the preferred embodiment, distal edge 112 is rounded to provide a more aerodynamic edge to sled 100. By forming distal edge 112 in this manner, sled 100 will have reduced water drag and will produce less turbulence when being towed. Of course, minor variations can be made, such as angling or pointing edge 112 rather than rounding it. The thickness of planar surface 102 is not important so long as it retains its shape and does not deform during use. Likewise, it should not be so thick as to become too heavy for convenient use. As a result, the thickness of planar surface 102 will vary based on the material used to fabricate it.

FIG. 4 illustrates sled 100 in the surface towing position. Boat 402 pulls sled 100 via tow rope 404. The diver raises the distal end of sled 100 above the waters surface 406, as shown, to keep sled 100 on the surface. In this position, the diver will be towed on the water's surface by the boat 402. When a diver releases sled 100, it has been found that if boat 100 is in motion, sled 100 will tend to dive below the surface. However, by flipping sled 100 upside down prior to release, the movement of water against the now submerged handles tends to push the distal edge 112 of sled 100 above the water line. As a result, sled 100 will stay on the surface after release by the diver.

Figure 5:
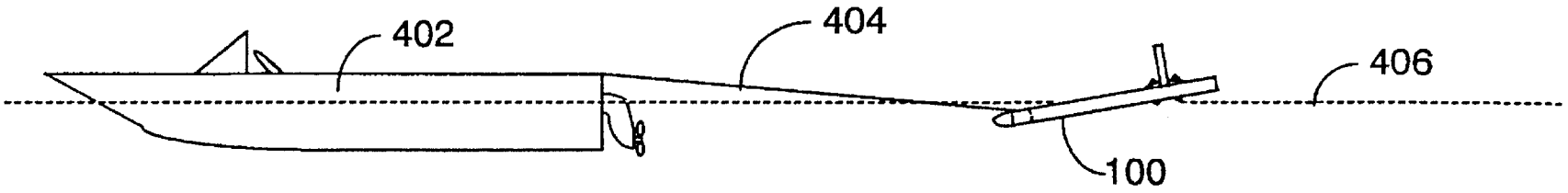
FIG. 5 illustrates the submersible aquatic sled with the distal end lowered to begin a dive into the underwater towing position.

FIG. 5 illustrates the sled 100 in the diving position. In this position, the distal end of sled 100 is lowered and the oncoming water pushes sled 100 and the diver below the water's surface 406.

Figure 6:
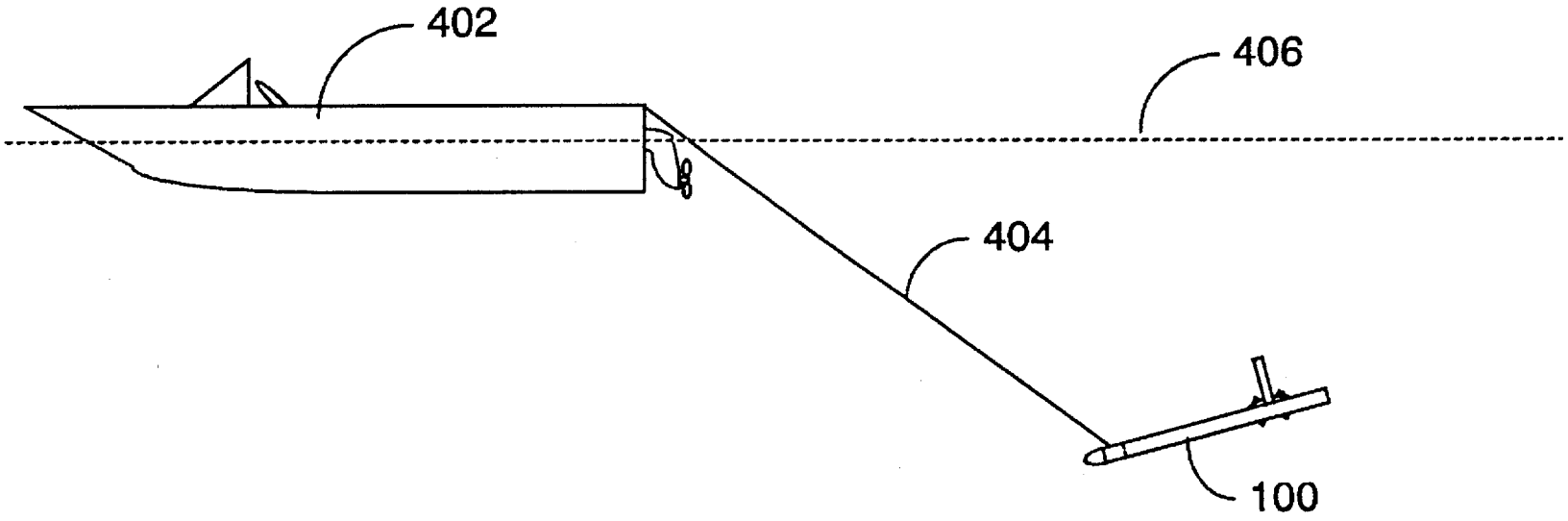
FIG. 6 illustrates the submersible aquatic sled fully submerged in a dive.

FIG. 6 illustrates the location of sled 100 as its distal end is held in the dive orientation. Sled 100 will continue to dive below the water's surface 406 while held in this position.

Figure 7:
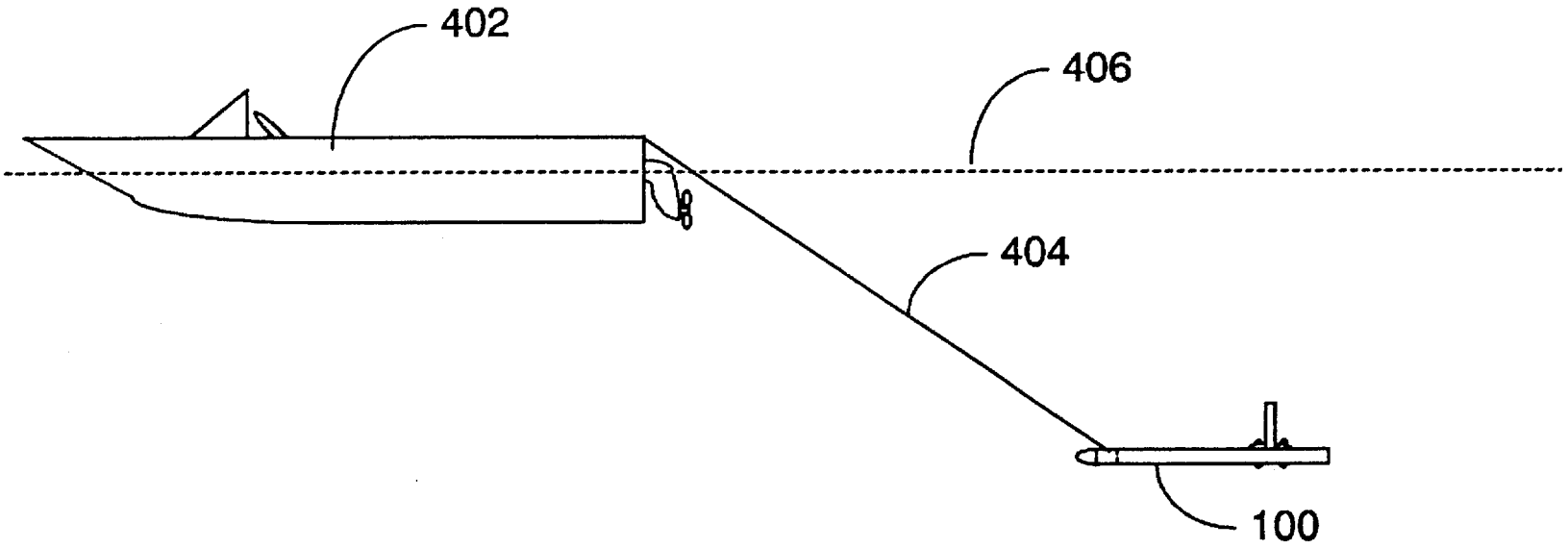
FIG. 7 illustrates the submersible aquatic sled fully submerged in a dive in the underwater towing position.

FIG. 7 illustrates sled 100 in submerged towing orientation. The diver can maintain location at a given depth by adjusting the orientation of planar surface 102 such that sled 100 can be towed below the water's surface 406. As a result, the diver is able to explore extensive areas underwater with relative ease.

Figure 8:
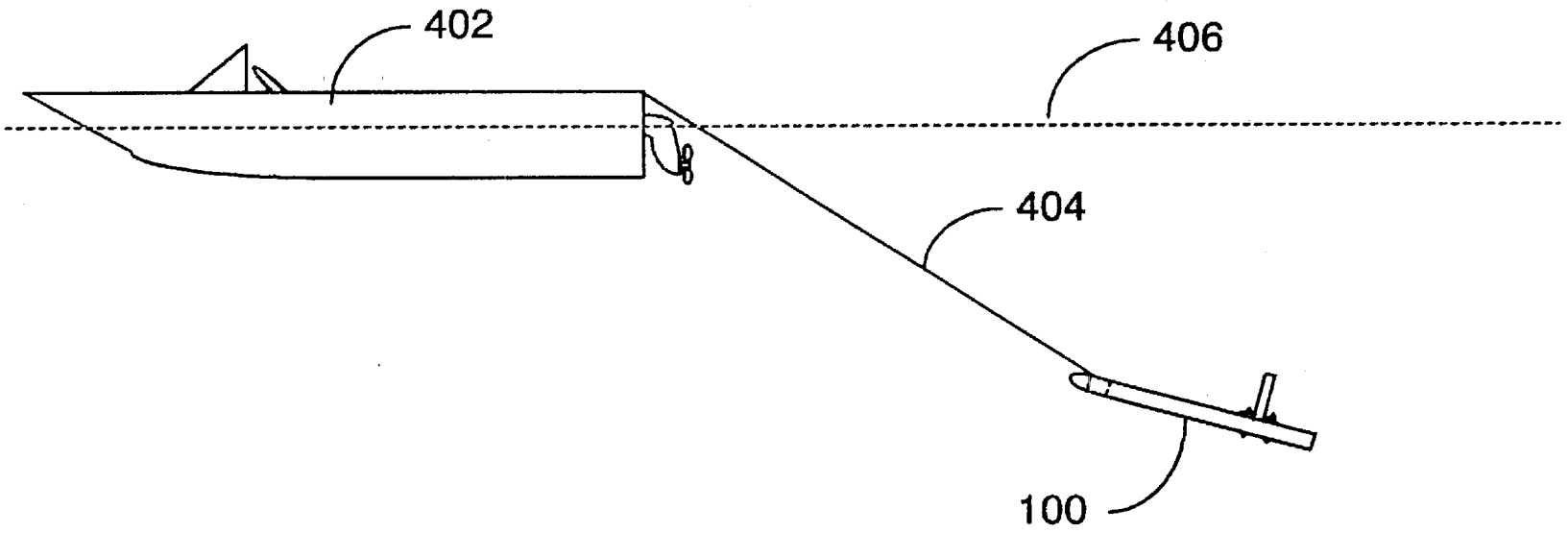
FIG. 8 illustrates the submersible aquatic sled fully submerged in the underwater ascending position of a dive.

In FIG. 8, sled 100 is shown in ascending position. By raising the distal end of sled 100, it is pulled back towards the water's surface 406.

Figure 9:
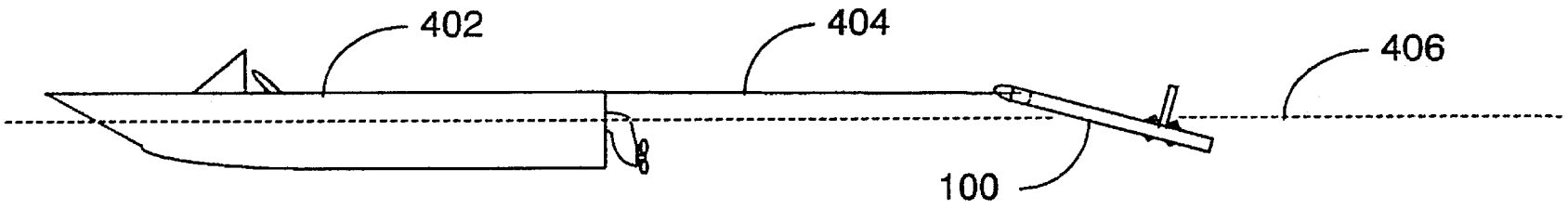
FIG. 9 illustrates the submersible aquatic sled fully ascended from a dive.

FIG. 9 illustrates the position of sled 100 at the end of the ascending process. When sled 100 reaches the water's surface 406, it resumes the surface towing position shown earlier in FIG. 4.

When a diver wishes to terminate towing, the diver only needs to release the handle assemblies 106, 108, 110 much the same as a water skier would release a tow rope. Likewise, manual or automatic release mechanisms could be attached to the tow rope 406 at either end to ensure that sled 100 disconnects from boat 402 in the event of snagging on underwater debris, etc.

As illustrated in FIGS. 4 through 9, sled 100 has a significant advantage over prior water sport devices in that it allows a diver the ability to be towed both above or below the water's surface 406. The advantages of this for recreational uses is readily apparent. In particular, a diver has the ability to go "sightseeing" over large areas. The prior art, while providing many alternative devices for surface use, does not provide for a combined surface and underwater use as is provided by sled 100.

In addition to recreational use, sled 100 is useful for non-recreational uses as well. For example, in search and rescue operations, police divers can rapidly cover large areas of water looking for bodies, evidence, etc. Likewise, maintenance personnel can inspect large underwater facilities in reduced amounts of time.

Figure 10:
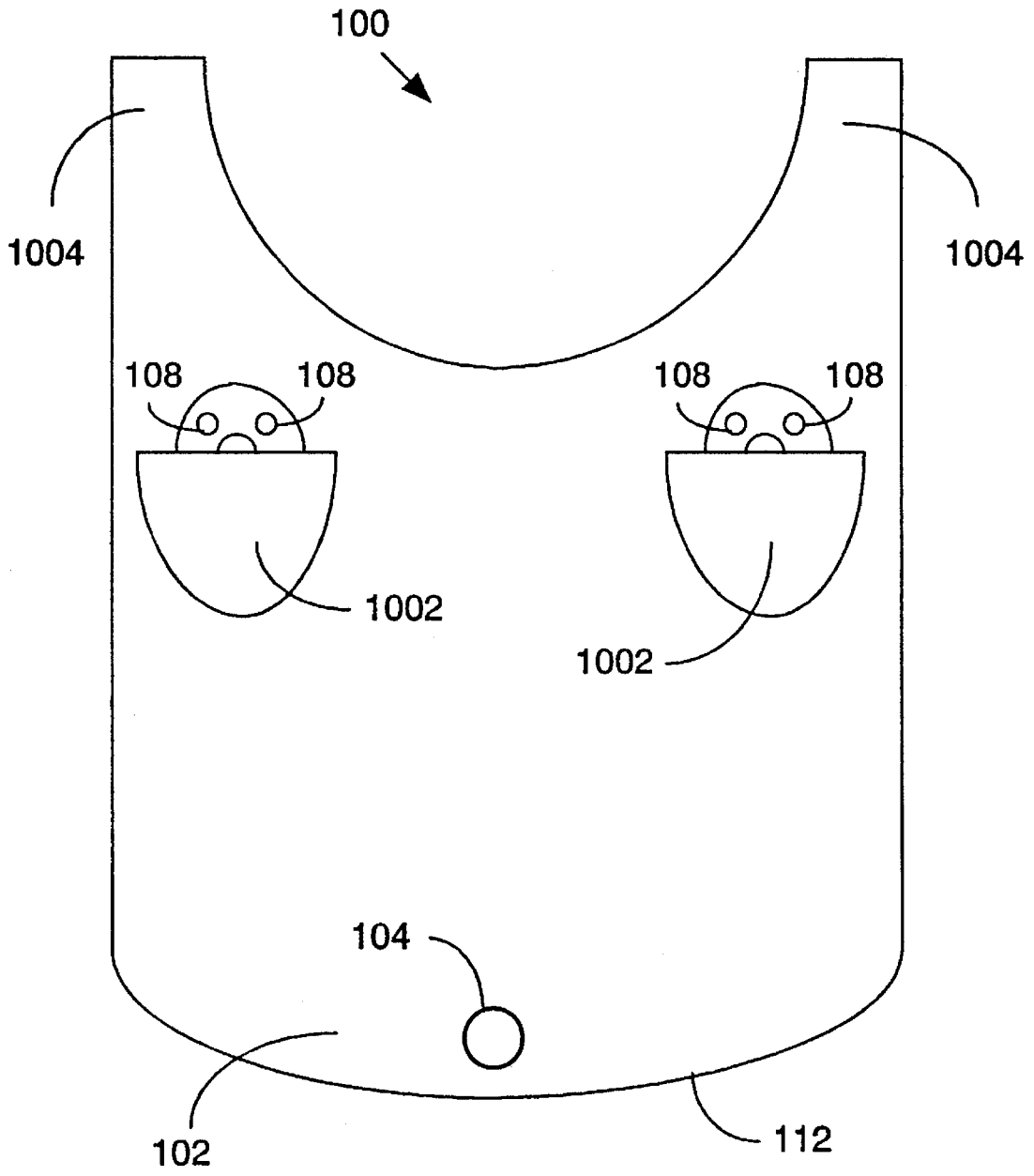
FIG. 10 illustrates an alternative embodiment of the submersible aquatic sled illustrating the hand shields and arm supports.

FIG. 10 is a top view illustrating an alternative embodiment of sled 100. In this embodiment hand shields 1002 are placed on the distal side of handle assemblies 106, 108, 110. Hand shields 1002 protect the hands of the diver from debris, etc., when sled 100 is towed. Further, if sled 100 is towed for extended periods of time, hand shields 1002 improve diver comfort by reducing the effect of the water impacting the diver's hands. Also shown are extended arms 1004 which provide support for the diver's arms.

Figure 11:
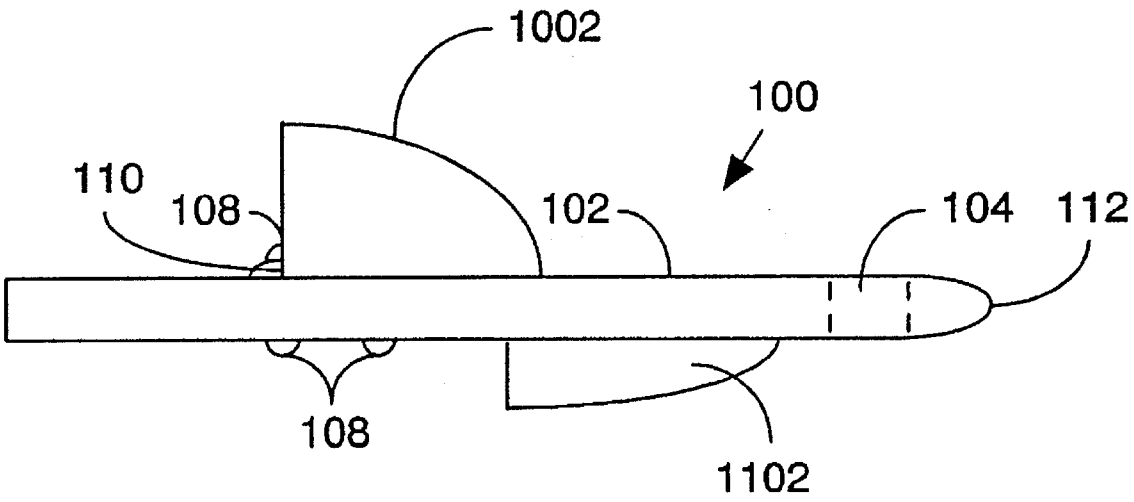
FIG. 11 is a side view of the alternative embodiment of the submersible aquatic sled shown in FIG. 10.

FIG. 11 is a side view of the embodiment shown above in FIG. 10. In this view, hand shield 1002 is shown extending above handle assembly 106, 108, 110. Also, an optional stabilizer fin 1102 is shown projecting from the bottom of planar surface 102. Optional stabilizer fin 1102 adds some stability and directional control to sled 100. Of course, it can be used with any of the embodiments of the invention.

Figure 12:
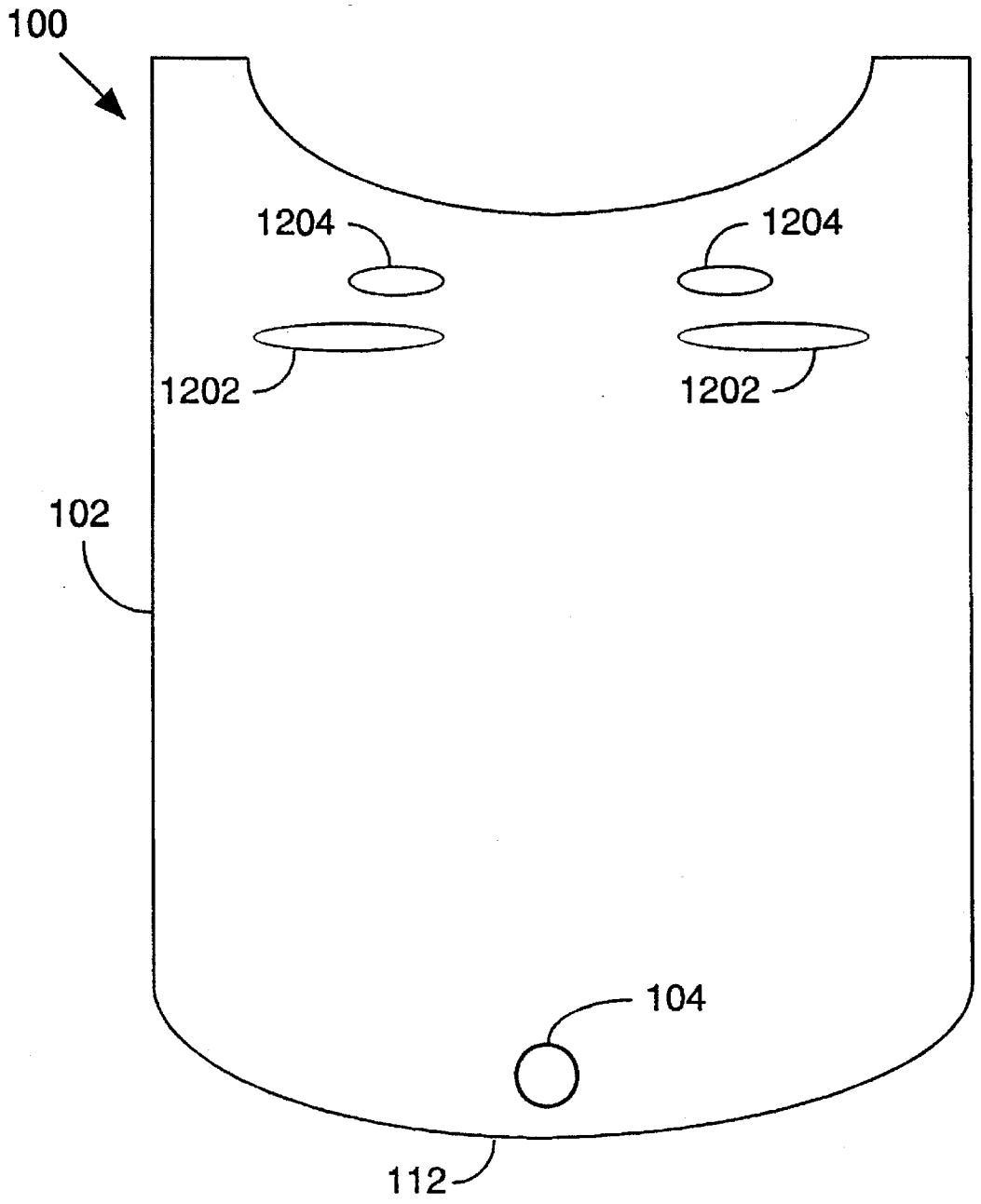
FIG. 12 illustrates another alternative embodiment of the submersible aquatic sled which replaces the handle assemblies with apertures that provide hand grips.

In FIG. 12, another alternative embodiment of sled 100 is illustrated. In this embodiment, handle assemblies 106, 108, 110 are replaced with hand apertures 1202, 1204. Hand apertures 1202 are sized to accept the fingers of the diver who controls the orientation of sled 100 directly. Hand apertures 1204 are sized to accommodate the diver's thumbs. Hand apertures 1202, 1204 provide a less expensive and more compact sled 100 than those shown in the previous embodiments. However, the handle assemblies 106, 108, 110 provide better leverage.

While the invention has been described with respect to a preferred embodiment thereof, it will be understood by those skilled in the art that various changes in detail my be made therein without departing from the spirit, scope, and teaching of the invention. For example, construction materials can vary, the handle assemblies can be constructed in a variety of ways, the tow rope attachment means can be the aperture used for illustration purposes or any other suitable method of securing a tow rope. Accordingly, the invention herein disclosed is to be limited only as specified in the following claims.

I claim:

1. A submersible aquatic sled for towing a diver in water with a tow rope, comprising:

a substantially planar surface having a distal end and a proximal end, the proximal end of the planar surface has extended arms on either side of the proximal end which provide arm supports;

tow rope attachment means at tile distal end of tile planar surface for securing the submersible aquatic sled to a tow rope; and steering means in the planar surface, the steering means capable of varying the orientation of the planar surface such that the submersible aquatic sled can be controllably steered from a surface towing position to an underwater towing position, and the steering means are located away from the proximal edge of the planar surface a sufficient distance to allow a diver's forearms to be supported by the planar surface while the steering means are being manipulated;

whereby a diver can steer the submersible aquatic sled such that the submersible aquatic sled can be towed at surface level or underwater.

2. A submersible aquatic sled, as in claim 1, wherein:

the steering means further comprises at least one handle assembly, each handle assembly secured to the planar surface and sized such that a diver's hand can securely grasp the handle assembly.

3. A submersible aquatic sled, as in claim 2, wherein:

the distal edge of the planar surface has an aerodynamically shaped leading edge.

4. A submersible aquatic sled, as in claim 3, further comprising:

hand shields attached to the planar surface, the hand shields located on the distal side of the handle assembly;

whereby a diver's hands are protected when the submersible aquatic sled is towed.

5. A submersible aquatic sled, as in claim 2, further comprising: p1 hand shields attached to the planar surface, the hand shields located on the distal side of the handle assembly;

whereby a diver's hands are protected when the submersible aquatic sled is towed.

6. A submersible aquatic sled, as in claim 3, further comprising:

a stabilizer fin attached to the planar surface on the side of the planar surface opposite the side where the handle assemblies are attached.

7. A submersible aquatic sled, as in claim 1, wherein:

the steering means further comprises at least one hand aperture in the planar surface, each hand aperture sized such that a diver's hand can securely grasp the planar surface.

8. A submersible aquatic sled, as in claim 7, wherein:

the distal edge of the planar surface has an aerodynamically shaped leading edge.

9. A submersible aquatic sled, as in claim 8, further comprising:

hand shields attached to the planar surface, the hand shields located on the distal side of the handle assembly;

whereby a diver's hands are protected when the submersible aquatic sled is towed.

10. A submersible aquatic sled, as in claim 7, further comprising:

hand shields attached to the planar surface, the hand shields located on the distal side of the handle assembly;

whereby a diver's hands are protected when the submersible aquatic sled is towed.

* * * * *